US008167559B2

(12) United States Patent
Liang

(10) Patent No.: US 8,167,559 B2
(45) Date of Patent: May 1, 2012

(54) TURBINE VANE FOR A GAS TURBINE ENGINE HAVING SERPENTINE COOLING CHANNELS WITHIN THE OUTER WALL

(75) Inventor: George Liang, Palm City, FL (US)

(73) Assignee: Siemens Energy, Inc., Orlando, FL (US)

( * ) Notice: Subject to any disclaimer, the term of this patent is extended or adjusted under 35 U.S.C. 154(b) by 501 days.

(21) Appl. No.: 12/396,660

(22) Filed: Mar. 3, 2009

(65) Prior Publication Data

US 2010/0226755 A1 Sep. 9, 2010

(51) Int. Cl.
*F01D 5/14* (2006.01)

(52) U.S. Cl. ..... 416/97 A; 415/115; 416/97 R

(58) Field of Classification Search ..... 416/97 R, 416/97 A; 415/115
See application file for complete search history.

(56) References Cited

U.S. PATENT DOCUMENTS

| | | | | |
|---|---|---|---|---|
| 4,565,490 | A | 1/1986 | Rice | |
| 5,375,973 | A | 12/1994 | Sloop et al. | |
| 5,383,766 | A * | 1/1995 | Przirembel et al. | 416/97 A |
| 5,419,039 | A * | 5/1995 | Auxier et al. | 29/889.721 |
| 5,733,102 | A | 3/1998 | Lee et al. | |
| 6,176,678 | B1 | 1/2001 | Brainch et al. | |
| 6,379,118 | B2 * | 4/2002 | Lutum et al. | 416/97 R |
| 6,551,061 | B2 | 4/2003 | Darolia et al. | |
| 7,094,031 | B2 * | 8/2006 | Lee et al. | 416/97 R |
| 7,097,424 | B2 | 8/2006 | Cunha et al. | |
| 7,118,326 | B2 | 10/2006 | Liang | |
| 7,296,972 | B2 | 11/2007 | Liang | |
| 7,306,424 | B2 | 12/2007 | Romanov et al. | |
| 7,347,671 | B2 * | 3/2008 | Dorling et al. | 416/97 R |
| 2002/0141870 | A1 | 10/2002 | Schafrik et al. | |
| 2003/0129054 | A1 | 7/2003 | Manning et al. | |
| 2006/0002788 | A1 | 1/2006 | Liang | |
| 2006/0222495 | A1 | 10/2006 | Liang | |
| 2007/0183893 | A1 * | 8/2007 | Horiuchi et al. | 416/97 R |
| 2010/0126960 | A1 * | 5/2010 | Cunha | 216/37 |

FOREIGN PATENT DOCUMENTS

| | | |
|---|---|---|
| EP | 1245787 A2 | 10/2002 |
| EP | 1726785 A2 | 11/2006 |
| JP | 64-083825 | 3/1989 |

* cited by examiner

*Primary Examiner* — Matthew Landau
*Assistant Examiner* — Joseph C Nicely

(57) ABSTRACT

A turbine vane for a gas turbine engine having an outer wall containing a plurality of serpentine cooling channels. The serpentine cooling channels may be configured to receive cooling fluids from internal cooling fluids supply channels. The serpentine cooling channels may be positioned in the pressure side and suction side outer walls and configured such that a first pass is positioned radially outward from an internal chamber a greater distance than a second pass. As such, cooling fluids are first passed proximate to an outer surface where the fluids are heated and then passed proximate to an inner surface, thereby establishing a smaller thermal gradient than typically found in conventional turbine blade outer walls.

20 Claims, 3 Drawing Sheets

TURBINE VANE FOR A GAS TURBINE ENGINE HAVING SERPENTINE COOLING CHANNELS WITHIN THE OUTER WALL

FIELD OF THE INVENTION

This invention is directed generally to gas turbine engines, and more particularly to turbine vanes for gas turbine engines.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine vane and blade assemblies to high temperatures. As a result, turbine vanes and blades must be made of materials capable of withstanding such high temperatures, or must include cooling features to enable the component to survive in an environment which exceeds the capability of the material. Turbine engines typically include a plurality of rows of stationary turbine vanes extending radially inward from a shell and include a plurality of rows of rotatable turbine blades attached to a rotor assembly for turning the rotor.

Typically, the turbine vanes are exposed to high temperature combustor gases that heat the airfoil. The airfoils include an internal cooling system for reducing the temperature of the airfoils. While there exist many configurations of cooling systems, there exists a need for improved cooling of gas turbine airfoils.

SUMMARY OF THE INVENTION

This invention is directed to a turbine vane for a gas turbine engine and may be configured to better accommodate high combustion gas temperatures than conventional vanes. In particular, the turbine vane may include an internal cooling system positioned within internal aspects of the vane and contained within an outer wall forming the vane. The portion of the internal cooling system contained within the outer wall may be formed from serpentine cooling channels. The serpentine cooling channels may be configured to receive cooling fluids from internal cooling fluids supply chambers. The serpentine cooling channels may be positioned in pressure and suction side outer walls and configured such that a first pass is positioned radially outward from an internal chamber a greater distance than a second pass. As such, cooling fluids are first passed proximate to an outer surface where the fluids are heated and then passed proximate to an inner surface, thereby establishing a smaller thermal gradient than typically found in convention turbine blade outer walls. The lower thermal gradient reduces the risk of turbine blade destruction.

In one embodiment, the turbine vane may be formed from a generally elongated airfoil formed from an outer wall, and having a leading edge, a trailing edge, a pressure side, a suction side generally opposite to the pressure side, a first endwall at a first end, a second endwall at a second end opposite the first end, and an internal cooling system positioned within the generally elongated airfoil. The internal cooling system may include at least one internal chamber positioned within the generally elongated airfoil. The turbine vane may also include at least one pressure side serpentine cooling channel contained within the outer wall at the pressure side and configured such that a first pass is positioned radially outward from an internal chamber a greater distance than a second pass. The turbine vane may include at least one suction side serpentine cooling channel contained within the outer wall at the suction side and configured such that a first pass is positioned radially outward from an internal chamber a greater distance than a second pass.

The serpentine cooling channels may be configured to effectively cool the outer wall of the turbine airfoil without creating a destructive temperature gradient. In particular, the first pass of the pressure side serpentine cooling channel may extend in a direction from the trailing edge to the leading edge, and the second pass may extend in a direction from the leading edge toward the trailing edge. The second pass may be in communication with at least one diffusion slot in the outer surface of the outer wall. The first pass of the at least one suction side serpentine cooling channel may extend in a direction from the leading edge to the trailing edge, and the second pass may extend in a direction from the trailing edge toward the leading edge. The second mass may be in communication with at least one diffusion slot in the outer surface of the outer wall. In such a configuration, the suction side and pressure side cooling channels have counterflow configurations relative to each other.

The pressure side serpentine cooling channel may be formed by a plurality of pressure side serpentine cooling channels having diffusion slots that are generally aligned into rows extending generally spanwise. The suction side serpentine cooling channel may be formed by a plurality of suction side serpentine cooling channels having diffusion slots that are generally aligned into rows extending generally spanwise. The pressure side serpentine cooling channel may include a pressure side inlet extending between the at least one internal chamber and the first pass. Similarly, the suction side serpentine cooling channel may include a suction side inlet extending between the at least one internal chamber and the first pass. The pressure side serpentine cooling channel may be coupled to a diffusion slot positioned inline with a hot gas side pressure gradient. The suction side serpentine cooling channel may be coupled to a diffusion slot positioned in closer proximity to the leading edge than the trailing edge where the pressure is lower than other areas, which maximizes cooling fluid potential.

The serpentine cooling channels may also include a plurality of microfins in the pressure side serpentine cooling channel and a plurality of microfins in the suction side serpentine cooling channel. The microfins may have a thickness of between about 0.01 inches and about 0.03 inches. The microfins may be positioned in rows of between about two and four microfins. The pressure side and suction side serpentine cooling channels may be sized such that channel heights are two times fin thicknesses. The channel widths of the pressure side and suction side serpentine cooling channels may be two times to four times the channel height. The microfins may be positioned in rows extending generally orthogonal to a direction of fluid flow in the pressure side and suction side serpentine cooling channels. The microfins may be offset from each other or may be aligned in adjacent rows.

An advantage of the internal cooling system is that the configuration of serpentine cooling channels positioned within the outer walls enables cooling fluids to be first passed close to the outer surface of the outer wall and then passed within close proximity of the inner surface, thereby limiting the temperature gradient to less than that found in conventionally cooled airfoils.

Another advantage of the internal cooling system is that the microfins increase the cooling effectiveness.

Yet another advantage of this invention is that the outer wall serpentine cooling channels are counter flow channels between the suction side and the pressure side, which enables the discharges to be positioned differently and more efficiently for the pressure and suction sides.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
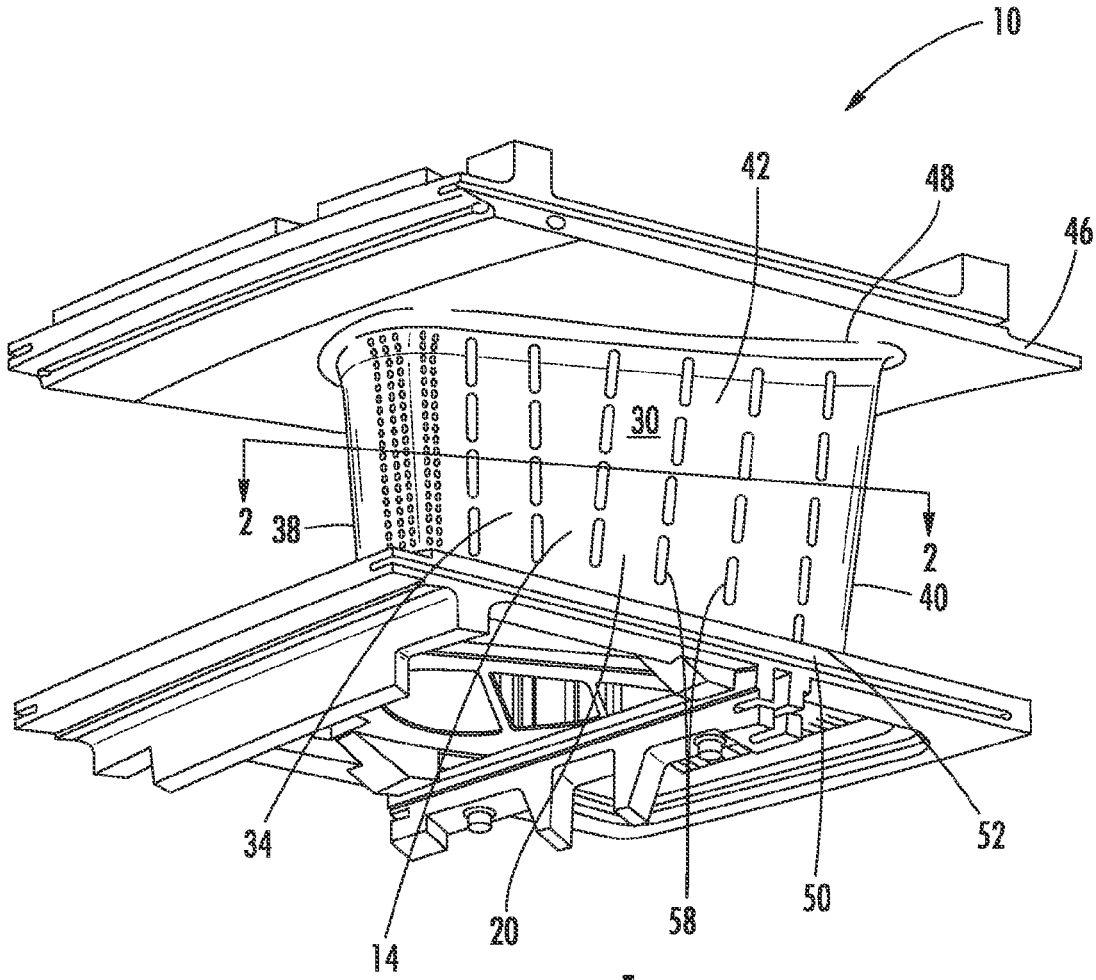
FIG. 1 is a perspective view of a turbine vane with aspects of this invention.

As shown in FIGS. 1-4, this invention is directed to a turbine vane 10 for a gas turbine engine. The turbine vane 10 may be configured to better accommodate high combustion gas temperatures than conventional vanes. In particular, the turbine vane 10 may include an internal cooling system 12 positioned within internal aspects of the vane 10 and contained within an outer wall 14 forming the vane 10. The portion of the internal cooling system 12 contained within the outer wall 14 may be formed from serpentine cooling channels 16. The serpentine cooling channels 16 may be configured to receive cooling fluids from internal cooling fluids supply chambers 18. The serpentine cooling channels 16 may be positioned in pressure and suction side outer walls 20, 22 and configured such that a first pass 24 is positioned radially outward from an internal chamber 18 a greater distance than a second pass 28. As such, cooling fluids are first passed proximate to an outer surface 30 where the fluids are heated and then passed proximate to an inner surface 32, thereby establishing a smaller thermal gradient than typically found in conventional turbine blade outer walls. The lower thermal gradient reduces the risk of turbine blade destruction.

The turbine vane 10 may have any appropriate configuration and, in at least one embodiment, may be formed from a generally elongated airfoil 34 formed from an outer wall 14, and having a leading edge 38, a trailing edge 40, a pressure side 42, a suction side 44 generally opposite to the pressure side 42, a first endwall 46 at a first end 48, a second endwall 50 at a second end 52 opposite the first end 48, and an internal cooling system 12 positioned within the generally elongated airfoil 34. The internal cooling system 12 may include at least one internal supply chamber 18 positioned within the generally elongated airfoil 34. The internal supply chamber 18 may have any appropriate configuration and may extend from the first endwall 46 to the second endwall 50.

One or more pressure side serpentine cooling channels 54 may be contained within the outer wall 14 at the pressure side 42 and may be configured such that a first pass 24 may be positioned radially outward from an internal supply chamber 18 a greater distance than a second pass 28. The first pass 24 of the pressure side serpentine cooling channel 54 may extend in a direction from the trailing edge 40 to the leading edge 38, and the second pass 28 may extend in a direction from the leading edge 38 toward the trailing edge 40 and may be in communication with one or more diffusion slots 58 in the outer surface 30.

One or more suction side serpentine cooling channels 56 may be contained within the outer wall 14 at the suction side 44 and may be configured such that a first pass 24 may be positioned radially outward from an internal chamber 18 a greater distance than a second pass 28. The first pass 24 of the suction side serpentine cooling channel 56 may extend in a direction from the leading edge 38 to the trailing edge 40, and the second pass 28 may extend in a direction from the trailing edge 40 toward the leading edge 38 and may be in communication with one or more diffusion slots 58 in the outer surface 30. The direction of cooling fluid flow through the suction side serpentine cooling channels 56 may be generally opposite to the direction of flow through the pressure side serpentine cooling channels 54. As such, the internal cooling system 12 has established counter flow of the cooling fluids.

Figure 2:
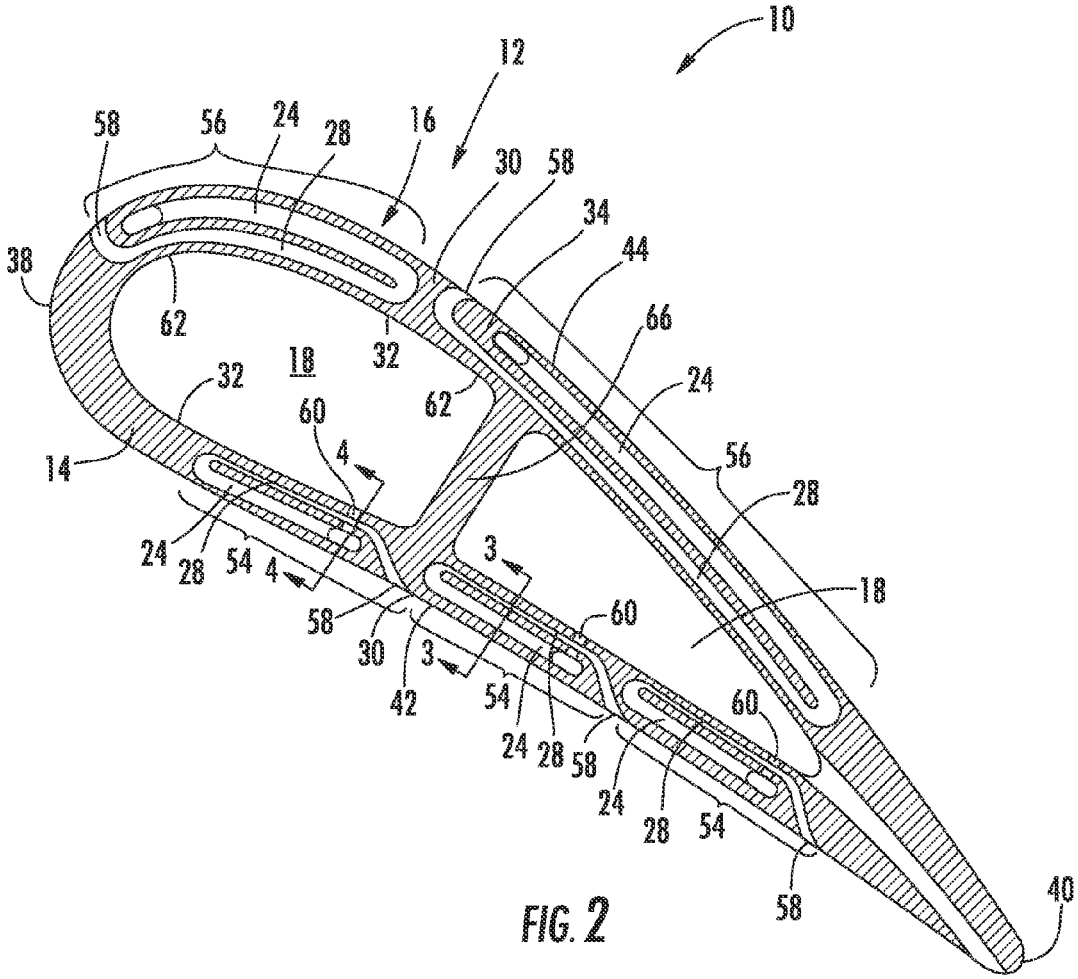
FIG. 2 is a cross-sectional view of the turbine vane taken at section line 2-2 in FIG. 1.

The diffusion slots 58 may have any appropriate configuration. The diffusion slots 58 may be generally aligned into rows extending generally spanwise and may also be aligned into rows extending generally chordwise. The diffusion slots 58 may be configured to reduce the velocity of the cooling fluids that are exhausted from the internal cooling system 12. In at least one embodiment, as shown in FIGS. 1 and 2, the pressure side serpentine cooling channel 54 may be formed from three rows of pressure side serpentine cooling channels 54 extending in the spanwise direction, and the suction side serpentine cooling channel 56 may be formed from two rows of suction side serpentine cooling channels 56 extending in the spanwise direction. The diffusion slots 58 of the rows of pressure side serpentine cooling channels 54 and suction side serpentine cooling channels 56 may also be aligned into rows corresponding with the serpentine cooling channels 54, 56 to which they are in communication.

The diffusion slots 58 may be positioned to maximize use of the cooling fluids for film cooling. In particular, the pressure side serpentine cooling channel 54 may be coupled to a diffusion slot 58 positioned inline with a hot gas side pressure gradient. In particular, as shown in FIG. 2, the diffusion slots 58 coupled to the pressure side serpentine cooling channel 54 may be positioned between a position at a midchord rib 66 and the trailing edge 40. The suction side serpentine cooling channel 56 may be coupled to a diffusion slot 58 positioned in closer proximity to the leading edge 38 than the trailing edge 40 where the pressure is lower than towards the trailing edge 40, which maximizes cooling fluid potential.

The pressure side serpentine cooling channel 54 may include a pressure side inlet 60 extending between the internal supply chamber 18 and the first pass 24. The suction side serpentine cooling channel 56 may include a suction side inlet 62 extending between the internal supply chamber 18 and the first pass 24. The inlets 60 and 62 provide a path for cooling fluids to travel between the internal supply chamber 18 and the serpentine cooling channels 54, 56. The inlets 60, 62 may have any appropriate configuration.

A plurality of microfins 64 may be positioned in the pressure side serpentine cooling channels 54, and a plurality of microfins 64 may be positioned in the suction side serpentine cooling channels 56. The microfins 64 may have any appropriate cross-sectional shape. In one embodiment, the microfins 64 may have a thickness of between about 0.01 inches and about 0.03 inches. The microfins 64 may be positioned into rows that extend generally orthogonal to a cooling fluid flow direction in the serpentine cooling channels 54, 56. The microfins 64 may be positioned in rows of between about two and four microfins 64. The microfins 64 may be offset from each other in adjacent rows or may be aligned with each other in adjacent rows.

Figure 3:
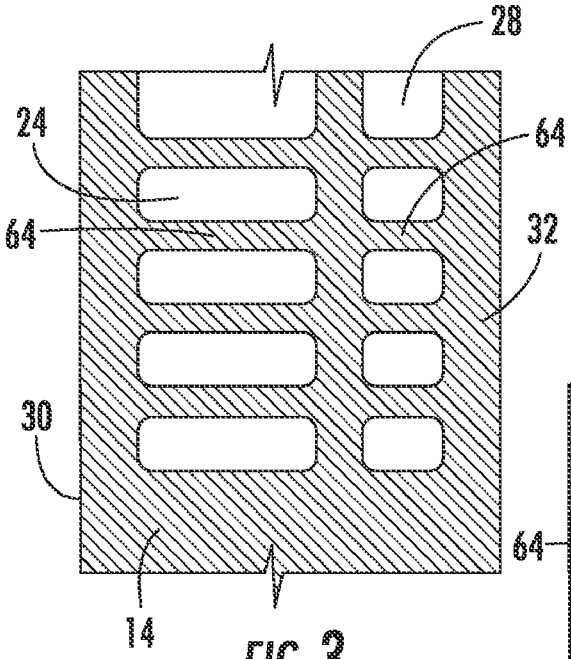
FIG. 3 is a partial cross-sectional view of the outer wall of the turbine vane taken at section line 3-3 in FIG. 2.
Figure 4:
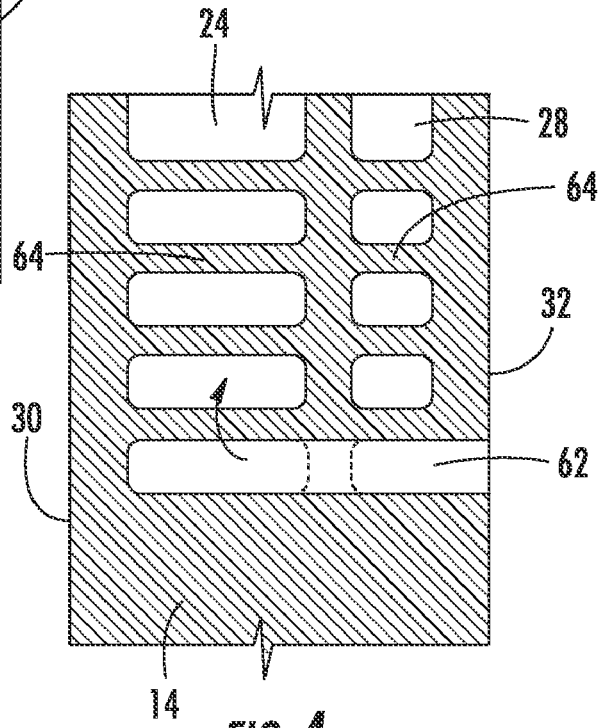
FIG. 4 is a partial cross-sectional view of the outer wall with an alternative configuration of the turbine vane taken at section line 4-4 in FIG. 2.

The pressure side serpentine cooling channel 54 and the suction side serpentine cooling channel 56 may be sized such that channel heights are about two times microfin thicknesses. The channel widths of the pressure side and suction side serpentine cooling channels 54, 56 may be about two times to four times the channel height. As shown in FIGS. 3 and 4, the first pass 24 may be about twice as wide as the second pass 28. The first pass 24 may include wider microfins 64 that may yield a higher convective surface area. The wider first pass 24 may provide a lower heat transfer coefficient in comparison to the second pass 28. The lower heat transfer coefficient produces a higher fin effectiveness, which correlates to a higher overall effective internal convective surface area that facilitates better cooling. The second pass 28 has a narrower width, which provides a higher internal heat transfer coefficient to heat up the inner wall.

The aspect ratio for the pressure side serpentine cooling channel 54 and the suction side serpentine cooling channel 56 may depend on the configurations of the channels 54, 56. The aspect ratio may be low because the spent cooling fluids may be discharged through the diffusion slots 58.

During use, cooling fluids may enter the turbine vane 10 into the internal supply chambers 18. The cooling fluids may then flow through various aspects of the cooling system 12 to cool the vane 10. At least a portion of the cooling fluids enter the pressure side or suction side inlets 60, 62. The cooling fluids flow through the first pass 24 in close proximity to the outer surface 30, thereby cooling the material forming the outer surface 30. The cooling fluids increase in temperature while passing through the first pass 24. The cooling fluids are passed into the second pass 28 proximate to the inner surface 32. The cooling fluids cool the material forming the inner surface, but to a lesser extent than the first pass 24. The configuration of the first pass 24 and the second pass 28 reduces the temperature gradient, thereby reducing the life shortening temperature gradient in the outer wall 14.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine vane for a gas turbine engine, comprising:

a generally elongated airfoil formed from an outer wall, and having a leading edge, a trailing edge, a pressure side, a suction side generally opposite to the pressure side, a first endwall at a first end, a second endwall at a second end opposite the first end, and an internal cooling system positioned within the generally elongated airfoil;

wherein the internal cooling system includes at least one internal chamber positioned within the generally elongated airfoil;

at least one pressure side serpentine cooling channel contained within the outer wall at the pressure side and configured such that an entire first pass is positioned radially outward from the at least one internal chamber a greater distance than a second pass of the pressure side serpentine cooling channel, wherein the first pass of the at least one pressure side serpentine cooling channel is configured to pass cooling fluids in a direction opposite to a direction of cooling fluid flow in the second pass of the at least one pressure side serpentine cooling channel; and at least one suction side serpentine cooling channel contained within the outer wall at the suction side and configured such that an entire first pass is positioned radially outward from the at least one internal chamber a greater distance than a second pass of the suction side serpentine cooling channel, wherein the first pass of the at least one suction side serpentine cooling channel is configured to pass cooling fluids in a direction opposite to a direction of cooling fluid flow in the second pass of the at least one suction side serpentine cooling channel.

2. The turbine vane of claim 1, wherein the first pass of the at least one pressure side serpentine cooling channel extends in a direction from the trailing edge to the leading edge and the second pass extends in a direction from the leading edge toward the trailing edge and is in communication with at least one diffusion slot.

3. The turbine vane of claim 1, wherein the first pass of the at least one suction side serpentine cooling channel extends in a direction from the leading edge to the trailing edge and the second pass extends in a direction from the trailing edge toward the leading edge and is in communication with at least one diffusion slot.

4. The turbine vane of claim 1, wherein the at least one suction side serpentine cooling channel comprises a plurality of suction side serpentine cooling channels having diffusion slots that are generally aligned into rows extending generally spanwise and wherein the at least one pressure side serpentine cooling channel comprises a plurality of pressure side serpentine cooling channels having diffusion slots that are generally aligned into rows extending generally spanwise.

5. The turbine vane of claim 4, wherein the at least one pressure side serpentine cooling channel comprises a pressure side inlet extending between the at least one internal chamber and the first pass and wherein the at least one suction side serpentine cooling channel comprises a suction side inlet extending between the at least one internal chamber and the first pass.

6. The turbine vane of claim 4, wherein the at least one pressure side serpentine cooling channel comprises three rows of pressure side serpentine cooling channels, and the at least one suction side serpentine cooling channel comprises two rows of suction side serpentine cooling channels.

7. The turbine vane of claim 1, further comprising a plurality of microfins in the at least one pressure side serpentine cooling channel and a plurality of microfins in the at least one suction side serpentine cooling channel.

8. The turbine vane of claim 7, wherein the microfins have a thickness of between about 0.01 inches and about 0.03 inches.

9. The turbine vane of claim 7, wherein the microfins are positioned in rows of between two and four microfins.

10. The turbine vane of claim 7, wherein the at least one pressure side serpentine cooling channel and the at least one suction side serpentine cooling channel are sized such that channel heights are two times fin thicknesses.

11. The turbine vane of claim 10, wherein channel widths of the at least one pressure side serpentine cooling channel and the at least one suction side serpentine cooling channel are two times to four times the channel height.

12. The turbine vane of claim 7, wherein the microfins are positioned in rows extending generally orthogonal to a direction of fluid flow in the pressure side and suction side serpentine cooling channels and wherein the microfins are offset from each other in adjacent rows.

13. The turbine vane of claim 7, wherein the microfins are positioned in rows extending generally orthogonal to a direction of fluid flow in the pressure side and suction side cooling channels and wherein the microfins are aligned with each other in adjacent rows.

14. The turbine vane of claim 1, wherein the at least one pressure side serpentine cooling channel is coupled to a diffusion slot positioned inline with a hot gas side pressure gradient, and wherein the at least one suction side serpentine cooling channel is coupled to a diffusion slot positioned in closer proximity to the leading edge than the trailing edge where the pressure is lower than other areas, which maximizes cooling fluid potential.

15. A turbine vane for a gas turbine engine, comprising:

a generally elongated airfoil formed from an outer wall, and having a leading edge, a trailing edge, a pressure side, a suction side generally opposite to the pressure side, a first endwall at a first end, a second endwall at a second end opposite the first end, and an internal cooling system positioned within the generally elongated airfoil;

wherein the internal cooling system includes at least one internal chamber positioned within the generally elongated airfoil;

at least one pressure side serpentine cooling channel contained within the outer wall at the pressure side and configured such that an entire first pass is positioned radially outward from the at least one internal chamber a greater distance than a second pass of the pressure side serpentine cooling channel, wherein the first pass of the at least one pressure side serpentine cooling channel is configured to pass cooling fluids in a direction opposite to a direction of cooling fluid flow in the second pass of the at least one pressure side serpentine cooling channel; and at least one suction side serpentine cooling channel contained within the outer wall at the suction side and configured such that an entire first pass is positioned radially outward from the at least one internal chamber a greater distance than a second pass of the suction side serpentine cooling channel, wherein the first pass of the at least one suction side serpentine cooling channel is configured to pass cooling fluids in a direction opposite to a direction of cooling fluid flow in the second pass of the at least one suction side serpentine cooling channel;

wherein the at least one pressure side serpentine cooling channel comprises a pressure side inlet extending between the at least one internal chamber and the first pass and wherein the at least one suction side serpentine cooling channel comprises a suction side inlet extending between the at least one internal chamber and the first pass;

wherein the first pass of the at least one pressure side serpentine cooling channel extends in a direction from the trailing edge to the leading edge and the second pass extends in a direction from the leading edge toward the trailing edge and is in communication with at least one diffusion slot;

wherein the first pass of the at least one suction side serpentine cooling channel extends in a direction from the leading edge to the trailing edge and the second pass extends in a direction from the trailing edge toward the leading edge and is in communication with at least one diffusion slot.

16. The turbine vane of claim 15, wherein the at least one suction side serpentine cooling channel comprises a plurality of suction side serpentine cooling channels having diffusion slots that are generally aligned into rows extending generally spanwise and wherein the at least one pressure side serpentine cooling channel comprises a plurality of pressure side serpentine cooling channels having diffusion slots that are generally aligned into rows extending generally spanwise.

17. The turbine vane of claim 15, wherein the at least one pressure side serpentine cooling channel comprises three rows of pressure side serpentine cooling channels, and the at least one suction side serpentine cooling channel comprises two rows of suction side serpentine cooling channels.

18. The turbine vane of claim 15, further comprising a plurality of microfins having a thickness of between about 0.01 inches and about 0.03 inches in the at least one pressure side serpentine cooling channel and a plurality of microfins having a thickness of between about 0.01 inches and about 0.03 inches in the at least one suction side serpentine cooling channel.

19. The turbine vane of claim 18, wherein the microfins are positioned in rows extending generally orthogonal to a direction of fluid flow in the pressure side and suction side serpentine cooling channels and wherein the microfins are offset from each other in adjacent rows.

20. The turbine vane of claim 15, wherein the at least one pressure side serpentine cooling channel is coupled to a diffusion slot positioned inline with a hot gas side pressure gradient, and wherein the at least one suction side serpentine cooling channel is coupled to a diffusion slot positioned in closer proximity to the leading edge than the trailing edge where the pressure is lower than other areas, which maximizes cooling fluid potential.

* * * * *